US005935026A

United States Patent [19]

Dill et al.

[11] Patent Number: 5,935,026

[45] **Date of Patent: *Aug. 10, 1999**

[54] LACROSSE STICK AND HEAD FRAME THEREFOR

[75] Inventors: James T. Dill, Rockport, Me.; William H. Brine, III, Hopkinton, Mass.

[73] Assignee: Sports Licensing, Inc., Hanover, N.H.

[ * ] Notice: This patent is subject to a terminal disclaimer.

[21] Appl. No.: 08/900,568

[22] Filed: Jul. 25, 1997

Related U.S. Application Data

[63] Continuation-in-part of application No. 08/567,600, Dec. 5, 1995, Pat. No. 5,651,549, which is a continuation of application No. 08/342,344, Nov. 18, 1994, abandoned.

[51] Int. Cl.[6] ..... A63B 59/02

[52] U.S. Cl. ..... 473/513

[58] Field of Search ..... 473/513

[56] References Cited

U.S. PATENT DOCUMENTS 5,651,549 7/1997 Dill et al. ..... 473/513
5,651,744 7/1997 Millon et al. ..... 473/513

*Primary Examiner*—William H. Grieb
*Attorney, Agent, or Firm*—Barry R. Blaker

[57] ABSTRACT

A lacrosse stick is provided having improved playability characteristics. The lacrosse stick involves a specified relationshp between the plane defined by the uppermost surface of the stick element relative to the location of the center of gravity of the head frame.

12 Claims, 4 Drawing Sheets

LACROSSE STICK AND HEAD FRAME THEREFOR

CROSS-REFERENCES TO RELATED APPLICATIONS

This application is a continuation-in-part of application Ser. No. 08/567,600, filed Dec. 5, 1995, now 5,651,549, said application Ser. No. 08/567,600 being a continuation of application Ser. No. 08/342,344, filed Nov. 18, 1994, now abandoned.

BACKGROUND OF THE INVENTION

The present invention relates generally to a lacrosse stick construction and is more particularly concerned with a novel lacrosse stick construction whereby improved playability and other functional benefits are realized.

FIGS. 1 and 1A hereof depict, in top and right side views, a preferred exemplar of the invention of our parent application and also depict, in broader terms, the general construction features of a modern molded plastic head frame. Thus, referring to FIGS. 1 and 1A there is depicted a lacrosse stick of the type comprising a stick element and a separate molded thermoplastic head frame affixed thereto. The straight stick element 1 defines a handle having a rearward butt end 2 and a forward end 3, said stick element 1 having a longitudinal center line $C_L$ and an uppermost surface 4 which, taken at the forward end 3, defines a plane P (FIG. 1A) which lies parallel to and spaced above the center line $C_L$. Coaxially affixed to the forward end 3 of the stick element 1 is a head 100 comprising a head frame 5 having a rearwardly facing coaxial fixation means which, in the embodiment shown in these drawings, takes the form of a socket 6 to receive the forward end 3 of the stick element 1 therein. The head frame 5 comprises a pair of side walls 7, 7' extending forwardly of the socket 6 in a symmetrical and laterally divergent manner from the center line $C_L$ and a nose element 8 which bridges the forward ends of the side walls 7, 7', thereby traversing the center line $C_L$. Where the fixation means comprises a socket 6, of course, it is to be appreciated that the plane P and the center line $C_L$ can also be determined by reference to the interior of said socket 6. As may best be seen in the top plan view of FIG. 1, the nose element 8 is desirably canted forwardly such that the upper edge 8' thereof is located forwardly of its bottom edge 8". Thus the nose element 8 defines a scoop shaped structure over which the reception of a ground ball is facilitated. At the rear of the head frame 5 and truncating the angle defined between the divergent side walls 7, 7' thereof is a rearwardly directed arcuate wall 12 whose radius of curvature is sufficient as to define a stop for the lacrosse ball. Typically, the interior surface of said arcuate wall 12 is lined with a soft, resilient padding 13. Said head frame 5 thus defines within the boundaries of the elements 8, 7, 7' and 12 an interior area of generally isosceles triangular geometry. Said area is broadly divisible, such as shown by the construction line A–A', into a forward zone F wherein the lacrosse ball is received and passed or shot and a rearward throat section T wherein the lacrosse ball resides during a player's possession thereof. In addition, the head frame 5 comprises an upper rim 9 defining the open mouth of the stick and a lower rim 10 having a plurality of apertures 11 spaced about the periphery thereof. In completion of the head 100 the usual netting, which for purposes of clarity is not shown, is affixed to and suspended from the lower rim 10 by means of said apertures 11, thereby to define a bottom closure of the head frame 5. Prior to the advent of the molded plastic head frame lacrosse sticks were generally of one-piece wooden construction wherein the forward end of the stick element, formed of ash, hickory or similar straight grained hardwood, transitions integrally into a head frame comprising a single side wall extending at a laterally divergent angle from the center line of the stick element and a nose element which transitions integrally from the forward end of the side wall element.

In accordance with the invention of our parent application the head 100 is provided with means by which its center of gravity is located at an effective distance below the plane P. By "effective distance" it is meant that the center of gravity of the head 100 is located sufficiently below the plane P as to enable the player using the lacrosse stick to sense the rotational orientation of the head 100 by the feel of the lacrosse stick in the player's hands. While the tactile sensitivities amongst a population of lacrosse players is variable and while the particular design and materials utilized in the construction of protective lacrosse gloves may itself significantly contribute to or detract from such tactile sensitivities, it has been found that this tactile sense is generally present when the center of gravity of the head 100 is located at or below the center line $C_L$ of the stick element 1. In our prior application the center of gravity of the head frame 5 is located below said plane P and preferably below said center line $C_L$ by means of an acutely depending step 14 or 14' formed along the length and preferably rearward of the mid-length of at least one of the side walls 7 or 7'. Where the head frame 5 is formed of molded plastic and comprises a pair of divergent side walls 7, 7' said side walls preferably comprise bilaterally symmetrical, acutely depending steps 14, 14' formed therein, said steps preferably being located rearwardly of the ball stop defined by the arcuate wall 12. This last-mentioned preferred embodiment of the invention can be prepared, for instance, by molding the plastic head frame 5 with a depending bend 15 interposed between the socket 6 and the arcuate wall 12.

As a result of the above-described construction, the lacrosse stick of our prior application is imbued with the ability to provide the player with tactile stimuli, acting through the stick element, which informs the player of the orientation of the head frame without the need for visual observation thereof. Thus, the player's attention need not be diverted from the field of play or the ball in order to establish proper orientation of the head frame of the stick for reception of the ball.

In accordance with the present invention we have discovered additional novel constructions by which said beneficial locating of the center of gravity of the head frame element to an effective distance below the plane defined by the uppermost surface of the stick element may be provided.

INCORPORATION BY REFERENCE

For purposes of a full and complete understanding of the present invention applicants incorporate herein, by express reference thereto, the entire disclosure of our parent application, Ser. No. 08/567,600, filed Dec. 5, 1995.

SUMMARY OF THE INVENTION

In accordance with one aspect of the invention there is provided a lacrosse stick head frame comprising a rearwardly facing coaxial fixation means for securing the head frame to an elongate stick element and, integral therewith, a forwardly extending frame element. The frame element of the construction comprises at least one side wall and preferably an opposed pair thereof, said side wall(s) extending forwardly from said coaxial fixation means in a laterally divergent direction from the center line thereof. The forward end of each said side wall has a nose element extending laterally inwardly therefrom and which nose element traverses said center line. The rear end(s) of said side wall(s) includes a rearwardly directed arcuate wall defining a ball stop. The frame element is integrally joined to the fixation means such that at said juncture, said frame element is acutely vertically displaced sufficiently downwardly from the upper surface of said fixation means such that the resulting center of gravity of the head frame lies at an effective distance below the plane defined by the uppermost surface of a stick element affixed to said fixation means. In preferred embodiments of the invention the head frame is formed of a molded plastic having a pair of bilaterally symmetrical side walls and said rearwardly directed coaxial fixation means takes the form of a socket of a size and shape adapted to receive the forward end of said stick element.

In accordance with another aspect of the invention dealing with the overall lacrosse stick construction, the locating of the center of gravity of the head frame to an effective distance below the plane defined by the uppermost surface of the straight portion of stick element is achieved by means of a stick element comprising a sinusoidally curved depending forward end portion which, in a preferred embodiment, is defined by a separable element interposed between the rearward straight portion of the stick element and the rearwardly and coaxially disposed fixation means of the head frame.

DESCRIPTION OF PREFERRED EMBODIMENTS

Figure 1:
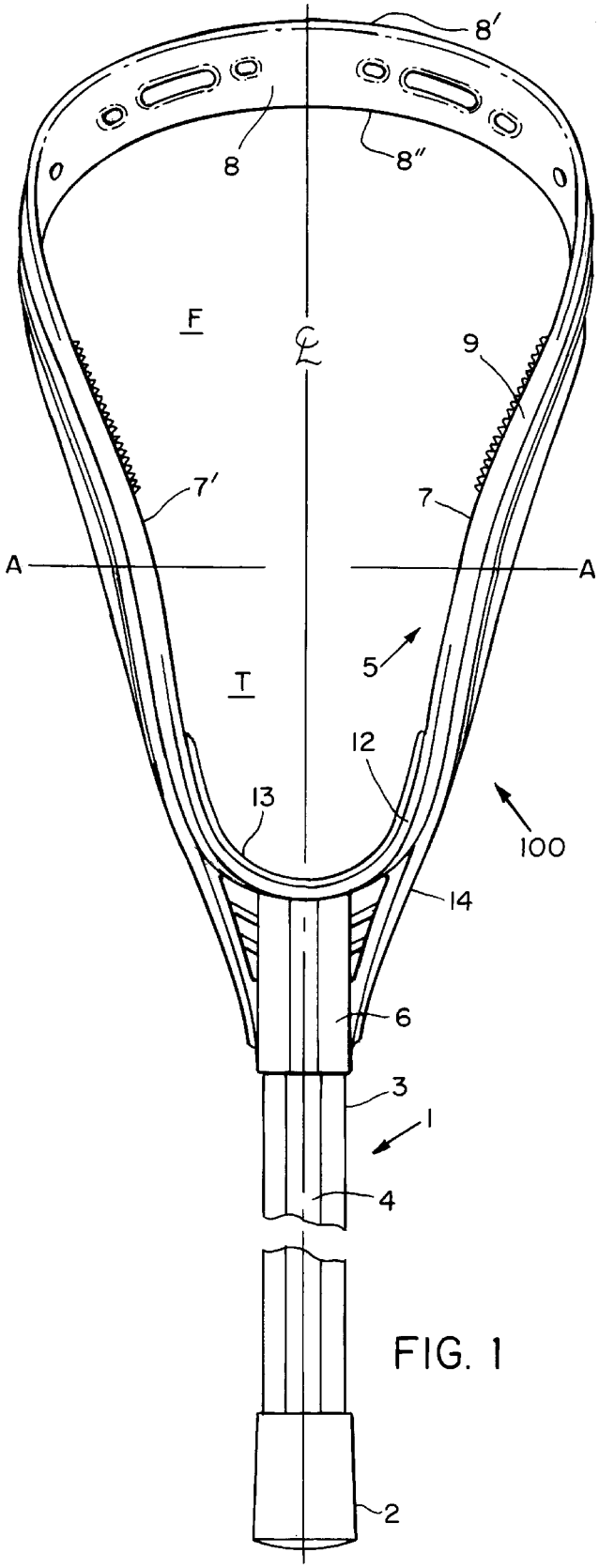
FIG. 1 hereof is a diagrammatic top plan view of a lacrosse stick equipped with a head frame in accordance with our parent application.
Figure 1A:
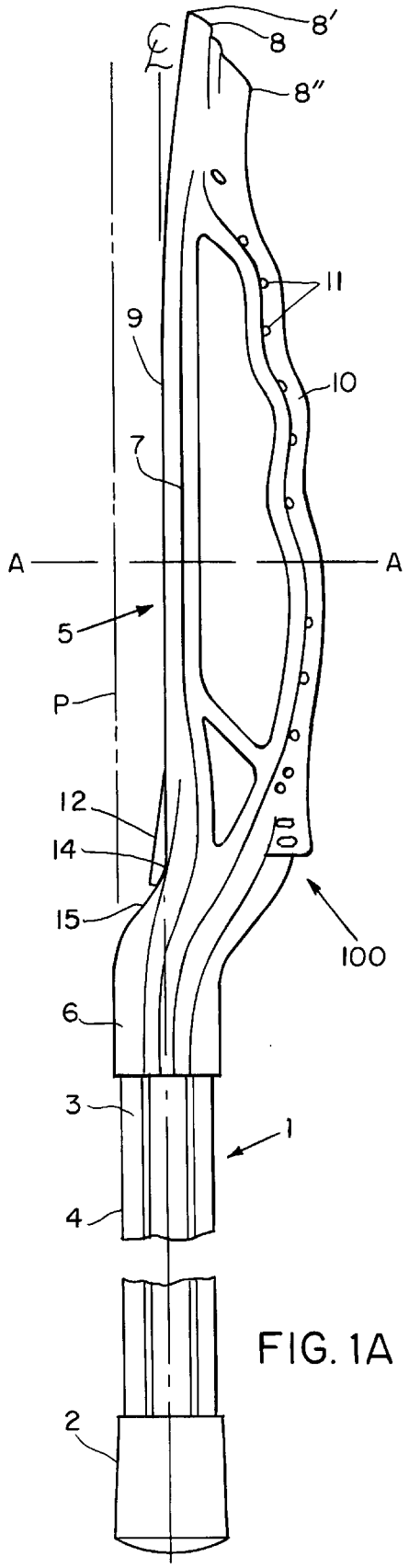
FIG. 1A is a diagrammatic right side view of the lacrosse stick of FIG. 1.
Figure 2:
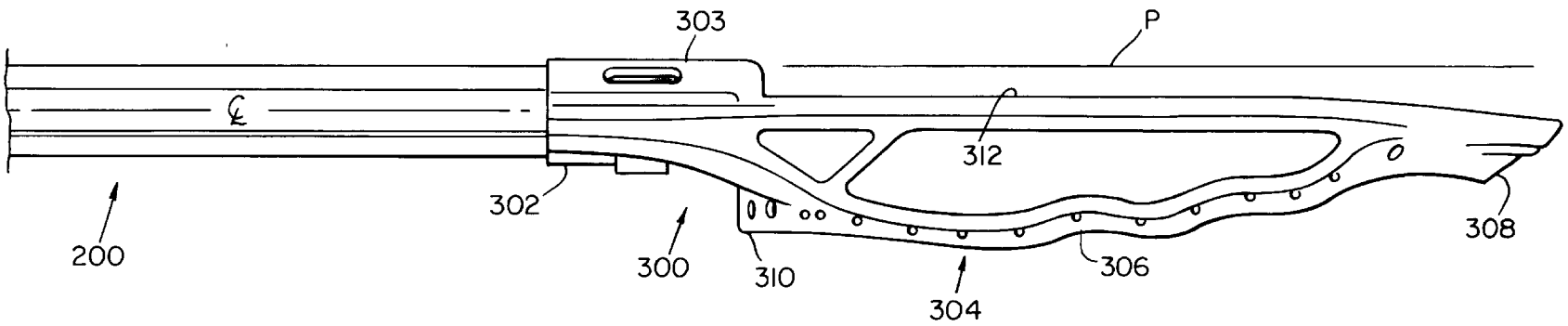
FIG. 2 is a diagrammatic right side view of one embodiment of a lacrosse stick in accordance with the present invention.

Referring now to FIG. 2, there is shown a lacrosse stick construction comprising a straight stick element 200 to the forward end of which there is affixed a head frame 300. The head frame 300 comprises a rearwardly facing coaxial fixation means 302 which, in the particular embodiment of the invention shown, takes the form of a socket to receive the forward end of the stick element 200. In the case of stick elements 200 of hollow construction, however, it is obvious that the coaxial fixation means 302 can also take the form of a male plug which fits within the bore of the forward end of the stick element 200. Integrally joined to the forward end of the coaxial fixation means 302 is a frame element 304 comprising at least one side wall 306 extending forwardly and laterally divergently from said fixation means 302, the forward end of said side wall 306 having an integral transverse nose element 308 extending laterally across the the centerline $C_L$ of the stick element 200 and the rear end of said side wall 306 having having an inwardly directed arcuate wall 310 which also crosses said centerline and defines a ball stop. Preferably, the frame element 304 comprises a pair of divergent side walls 306 extending forwardly of the fixation means 302, said divergent side walls being integrally joined to said arcuate wall 310 and said nose element 308. In accordance with one aspect of the invention the junction of the frame element 304 with the forward end of the fixation means 302 is acutely displaced sufficiently downwardly from the upper surface 303 of said fixation means 302 such that the center of gravity of the head frame 300 lies at an effective distance below the plane P of the stick element 200 and, preferably, is at or below the longitudinal centerline $C_L$ of said stick element. In the case of head frames of molded plastic construction this geometric relationship between said fixation means 302 and the frame element 304 is readily achieved by suitable design of the mold. In the case of wooden head frames, the aforedescribed geometric relationship can be achieved by suitable carving of the head frame. In the particular embodiment of the invention of FIG. 2 the upper rim 312 of the frame element 304 is depicted as being parallel to the longitudinal centerline $C_L$ of the stick element 200. However, as will be obvious to those of skill in the art, said frame element 304 can also be integrally joined to the fixation means 302 such that said frame element is carried at a positive or negative angle of incidence with respect to said centerline so long as the center of gravity of the resulting head frame 300 lies at an effective distance below the plane P.

Figure 3:
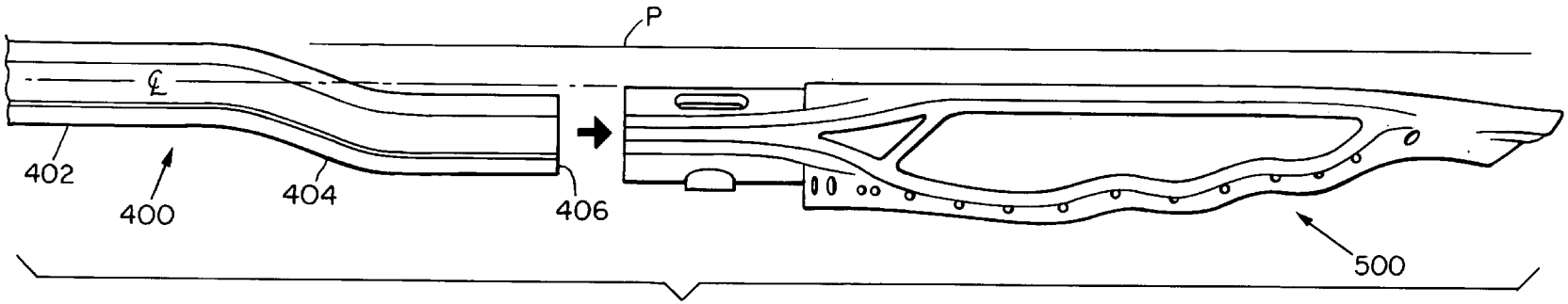
FIG. 3 is a diagrammatic partially exploded right side view of another embodiment of a lacrosse stick in accordance with the present invention.

Referring now to FIG. 3 hereof, there is shown another aspect of the invention whereby the center of gravity of the head frame of a lacrosse stick may be effectively displaced downwardly. Here, there is shown a stick element 400 having a straight rear or butt section 402 and a sinusoidally dependingly curved forward end portion 404. The forward end 406 of the stick is joined to a head frame 500. Where the stick element 400 is formed of wood, such as one-piece lacrosse sticks made of a tough, straight grained wood, the sinusoidally dependingly curved forward end portion 404 of the stick element 400 may be formed, for instance, by steam bending. In the case of modern day two-piece lacrosse sticks comprising a tubular metal or polymer composite stick element 400 joined to a separate and distinct molded plastic head frame 500, the sinusoidally dependingly curved end portion 404 can be formed by such techniques as hydrostatic forming of metal or pultrusion or laying up of a polymer composite stick over a suitably bent mandrel. In this embodiment of the invention the plane P of the uppermost surface of the stick element 400 is, of course, taken at the straight rear or butt section 402 of the stick element, as shown. Moreover, the curvatures of the sinusoidally dependingly curved end portion 404 are selected such that the forward end 406 thereof is sufficiently displaced below the plane P such as to place the center of gravity of the head frame 500 joined thereto an effective distance below said plane P and, in a preferred embodiment, to place said center of gravity of the head frame at or below the longitudinal centerline $C_L$ of the straight rear section 402 of the stick element. As previously mentioned with respect to the embodiment of the invention shown in FIG. 2, the conformation of the forward end 406 of the stick element 400 can also be such that the head frame 500 joined thereto is carried at a positive or negative angle of incidence relative to the longitudinal centerline $C_L$ of said stick element.

Figure 4:
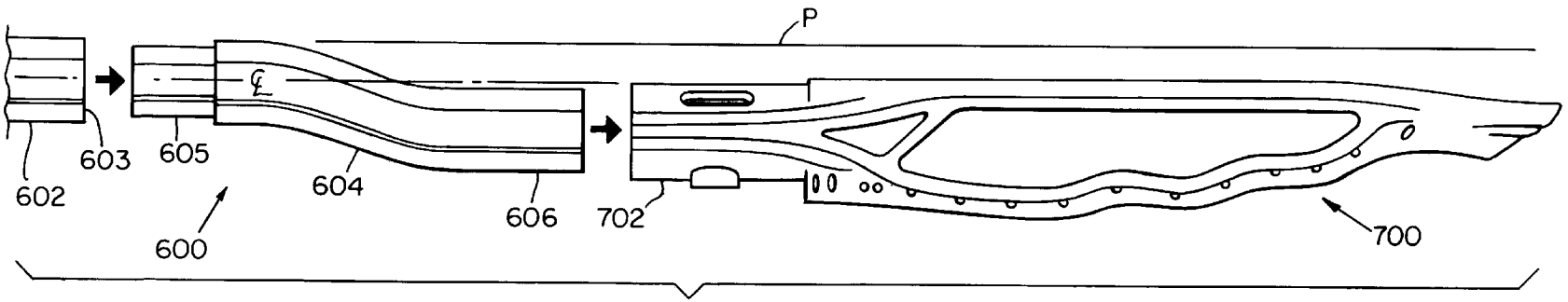
FIG. 4 is a diagrammatic partially exploded right side view of still another embodiment of a lacrosse stick in accordance with the present invention.

FIG. 4 depicts an alternative embodiment to that shown in FIG. 3. Referring to FIG. 4 there is shown a stick element 600 comprising a straight rear or butt section 602 and a separate and distinct sinusoidally and dependingly curved forward portion 604. The rear end of said forward portion 604 is provided with fixation means 605, such as a plug, whereby said forward portion 604 may be secured to the forward end 603 of the straight butt section 602. The forward end 606 of said forward portion 604 is of the same exterior geometry and dimensions as the exterior of the forward end 603 of the straight butt section 602. Said forward end 606 is received into the fixation means 702 of head frame 700, which in the embodiment of the invention shown, takes the form of a socket. Thus, in the embodiment of the invention shown in FIG. 4, the player is provided with the opportunity to either utilize the present invention or, in the alternative, to simply join the straight rear butt section 602 of the stick element 600 directly to the head frame 700. Morever, the sinusoidally and dependingly curved forward portion 604 of the stick element 600 can be readily formed separate and apart from the straight rear butt portion 602, such as by injection molding of a tough thermoplastic material, for example, a glass reinforced nylon or acrylonitrile-butadiene-styrene copolymer.

It is to be understood that the present invention is not to be limited to the particular constructions disclosed hereinbefore and/or shown in the drawings, but also comprises any modifications or equivalents thereof within the scope of the appended claims.

What is claimed is:

1. A lacrosse stick head frame comprising:

A) fixation means to coaxially affix said head frame to a stick element therefor, said fixation means having a rear end a forward end;

B) a frame element integrally joined to the front end of said fixation means, said frame element comprising at least one side wall extending forwardly and laterally divergently from said fixation means and having rear and forward ends, a nose element extending transversely inwardly from the forward end of said side wall and a rearwardly and directed arcuate wall extending inwardly from the rear end of said side wall and defining a ball stop, the juncture of said frame element to said fixation means being sufficiently acutely displaced downwardly therefrom such that the resulting center of gravity of the head frame lies at an effective distance below the plane defined by the uppermost surface of a stick element affixed to said fixation means, whereby a player is enabled to sense orientation of said head frame through the tactile stimuli generated by said head frame acting through said stick element.

2. The lacrosse stick head frame construction of claim 1 said juncture of said frame element to said fixation means is sufficiently acutely displaced downwardly therefrom such that the center of gravity of the head frame lies at or below the longitudinal centerline of said stick element.

3. The lacrosse stick head frame construction of claim 1 wherein said frame element comprises a pair of side walls extending forwardly and laterally divergently from said fixation means and said transverse nose element extends inwardly from the forward ends of said pair of side walls.

4. The lacrosse stick head frame construction of claim 1 wherein said fixation means defines a socket.

5. The lacrosse stick head frame construction of claim 1 composed of a molded plastic material.

6. A lacrosse stick head frame adapted to receive a lacrosse stick having a longitudinal centerline, comprising:

an integral frame having a center of gravity and comprising a forward nose;

two opposing spaced apart sidewalls, each having an upper rim and forward and rearward ends, said opposing sidewalls defining therebetween a forward zone and a rearward throat section, the front end of each sidewall joined to said forward nose;

a rearward wall having an upper rim, said rearward wall joined to the rearwards ends of said sidewalls; and fixation means extending rearwardly of said rearward wall to coaxially affix said head frame to said stick;

wherein at least a section of said upper rims of said sidewalls, within the portion of said sidewalls which defines the rearward throat section, is at or below said centerline and substantially remains at or below said centerline forwardly of said rearward throat section to said forward nose.

7. The head frame of claim 6 wherein the center of gravity thereof is at said centerline.

8. The head frame of claim 6 wherein the center of gravity thereof is below said centerline.

9. The head frame of claim 6 wherein said section of said upper rims is at said centerline.

10. The head frame of claim 6 wherein said section of said upper rims is below said centerline.

11. The head frame of claim 6 wherein said fixation means defines a socket.

12. The head frame of claim 6 composed of a molded plastic material.

* * * * *